United States Patent [19]

Brigham et al.

[11] 4,160,661

[45] Jul. 10, 1979

[54] PROCESS FOR THE PRODUCTION OF FERROMOLYBDENUM IN AN ELECTRIC ARC FURNACE

[75] Inventors: Robert J. Brigham; Guy V. Sirianni; Andrew Garner, all of Ottawa, Canada

[73] Assignee: Placer Development Limited, Vancouver, Canada

[21] Appl. No.: 902,427

[22] Filed: May 3, 1978

[30] Foreign Application Priority Data

Dec. 23, 1977 [CA] Canada ..... 293919

[51] Int. Cl.[2] ..... C21C 5/52

[52] U.S. Cl. ..... 75/12; 75/129; 75/133

[58] Field of Search ..... 75/10–12, 75/129, 133

[56] References Cited

U.S. PATENT DOCUMENTS

| | | | |
|---|---|---|---|
| 2,621,119 | 12/1952 | Loveless | 75/12 |
| 3,020,151 | 2/1962 | Nachtman | 75/10 R |
| 3,298,823 | 1/1967 | Sump | 75/10 R |

*Primary Examiner*—P. D. Rosenberg

*Attorney, Agent, or Firm*—Frishauf, Holtz, Goodman & Woodward

[57] ABSTRACT

The invention is directed to a process which consistently produces a ferromolybdenum alloy useful as a furnace additive with a molybdenum content of at least 50% by weight and a carbon content of not more than 0.1% by weight with a high recovery of molybdenum. In the process which may be carried out in an electric arc furnace, a charge of molybdenum oxide concentrate, lime and a carbonaceous reducing agent such as coke is fed to a bath containing iron suitably covered by a layer of slag. The coke is fed in an amount sufficient to reduce the molybdenum oxide which itself is added in an amount to provide the required property of molybdenum in the alloy. Molybdenum in the slag is stripped with a carbonaceous material such as coke in order to enhance the overall recovery of molybdenum in the process. The process itself can be carried out either on a batch or continuous basis.

11 Claims, 1 Drawing Figure

PROCESS FOR THE PRODUCTION OF FERROMOLYBDENUM IN AN ELECTRIC ARC FURNACE

BACKGROUND OF THE INVENTION

The present invention relates to the production of ferromolybdenum alloy useful as a furnace additive. In particular, the present invention relates to the production of a ferromolybdenum alloy having a molybdenum content of at least 50% by weight and a carbon content of not more than 0.1% by weight with a high recovery of molybdenum, desirably in the order of at least 96% by weight, in which process a molybdenum oxide concentrate is reduced in a molten iron containing slag bath in a furnace using a carbonaceous reducing agent for reducing the concentrate.

Heretofore, ferromolybdenum has been commercially produced from a molybdenum oxide concentrate by means of the thermite or ferrosilicon reduction process to ASTM Specification A132 (60% molybdenum minimum, 0.1% carbon maximum, 0.05% phosphorous maximum, 0.15% sulphur maximum, 1.0% silicon maximum, 1.0% copper maximum, 0.01% lead maximum and 0.01% tin maximum). However, ferrosilicon as a reductant in a thermite process is an expensive material, its supply is becoming more limited and the production of high grade ferrosilicon for use in the process is inefficient electrically and involves a substantial expenditure in energy.

Attempts have previously been made to produce ferromolybdenum in an electric arc furnace using carbon as the reductant as this is usually a plentiful material and is inexpensive. Examples of such attempts are given in Elyutin et al "Production of Ferro-Alloys: Electrometallurgy", translated by T. R. Shapiro, pp. 256–287, National Science Foundation, Washington, D.C. 1961 and B.I.O.S. Final Report No. 798 "The German Ferro-Alloy Industry", London, December, 1945. However, such procedures have heretofore produced only high carbon, high silicon, low molybdenum ferromolybdenum alloys with relatively poor overall molybdenum recoveries. In particular, in one of the procedures set forth in the aforesaid Elyutin publication, ferromolybdenum was produced from roasted molybdenum oxide concentrate by carbon reduction in a low power single phase electric furnace lined with coal. In the procedure the calcined concentrate was briquetted with coal dust and fed into the electric furnace adding at the same time, lime and iron. Smelting was carried out by fusing on the block at low temperature. The alloys obtained are stated to have in a number of cases a high carbon content and are resmelted and decarburized.

In another procedure, molybdenum has been smelted using a carbon containing reducing agent in a small single phase 300 to 500 kw and a three phase 500 to 1500 kw electric furnace in which the wall lining is rammed dolomite, and the hearth is coal. In such a method the charge consists of briquettes of roasted molybdenum concentrate with charcoal or peat coke. Powdered lime, iron powder and other materials are used as binder. The block waste and the slag of previous smelting are melted first, then briquettes of the conventional composition are added gradually. After sufficient quantity of the metal has been formed on the hearth, briquettes with an insufficient content of reducing agent are fed to the furnace in order to reduce the carbon content. During the smelting period a certain quantity of iron was added to the bath. The alloy produced by such a process contained 35 to 50% molybdenum, 1 to 2% silicon and 6 to 8% carbon. Such alloys are totally unsatisfactory in that they do not in any way meet the above ASTM Specification as set forth above and further, the molybdenum recovery in the process is low and renders these processes commercially unviable.

BRIEF SUMMARY OF INVENTION

The present invention provides a viable commercial process using a carbonaceous reducing agent in a furnace, preferably an electric arc furnace for the production of a ferromolybdenum alloy containing at least about 50% molybdenum, a low carbon content of 0.1% maximum with a high moloybdenum recovery of in the order of about 96% in conventional production sized electric arc furnaces.

According to the present invention, there is provided a process for the production of a ferromolybdenum alloy having a molybdenum content of at least about 50% by weight and a carbon content not exceeding 0.1% by weight which process comprises introducing into a melt containing iron in a furnace, a charge of a molybdenum oxide concentrate; a carbonaceous reductant for said concentrate and a source of lime, said molybdenum oxide concentrate being charged in an amount to provide the required concentration of molybdenum in the alloy and the carbon reductant being charged in an amount to cause reduction of the molybdenum oxide concentrate; simultaneously smelting said charge in said melt to form a molten ferromolybdenum alloy bath with a slag covering said bath; adding a carbonaceous material to said slag in an amount sufficient to cause a substantial proportion of molybdenum contained in said slag to be stripped therefrom and pass into said bath; and recovering molten ferromolybdenum alloy from said bath not exceeding 0.1% by weight of carbon.

As previously stated, by introducing into a molten bath containing iron and covered with a slag, a charge of molybdenum oxide concentrate, a carbonaceous reductant for the molybdenum oxide concentrate and lime, it is possible to effect the process with good reproducibility and establish steady state conditions providing for close control of both the carbon and molybdenum content in the molten alloy in the bath and thus faciliate the production on a commercial scale of a ferromolybdenum alloy having a molybdenum content of at least about 50% by weight and a maximum carbon content of 0.1% by weight. The process also provides for the high recovery of molybdenum from the oxide concentrate which with subsequent stripping of molybdenum in the slag at the termination of the smelting provides for such recovery to be in the order of 96% by weight of the molybdenum added as concentrate. Such control of the process could not be achieved in the process described in the aforesaid disclosures inter alia as the procedures involved fusing on the block with the lining of the furnace in contact with the melt, being a carbonaceous material, i.e. coal.

In the smelting part of the process of the present invention, the charge is continually added during smelting. The carbonaceous reductant in the charge may suitably be coal or coke and is preferably coke. The source of lime may be any material which produces lime in the process and may be for example limestone. However, burnt lime is the preferred material. The iron may be produced in the bath by the addition thereto of pig iron, iron oxide, such as iron ore, or steel. Preferably the source of iron is steel scrap.

Any suitable type of furnace may be employed, but we prefer an electric furnace and more specifically, an electric arc furnace. A 3000 kVa arc furnace is considered adequate for operation on a commercial scale.

In the smelting stage of the process of the present invention, it has been found that a significant amount of molybdenum from the molybdenum oxide concentrate, at the termination of the smelting, is retained in the slag which slag is normally discarded and this proportion which may be up to 5 or 6% by weight or even higher of the molybdenum present in the molybdenum concentrate is unacceptable for a commercial scale process. Therefore, in order to recover, at least a substantial proportion of this molybdenum in the slag which is present in both physically occluded and chemically combined form, in the process of the present invention, at the termination of the smelting stage of the process, the slag is stripped of the molybdenum by the addition of a sufficient amount of carbon thereto which causes the molybdenum to pass from the slag downwardly into the melt of the ferromolybdenum alloy thereby increasing the proportion of molybdenum in the alloy. In order to faciliate such slag stripping and to minimize the physical occulsion of the molybdenum in the slag, it has been found that the slag should preferably be basic in nature, and further, it has been found desirable in some cases to add a fluidization agent such as fluospar to the slag in order to increase the fluidity of the slag.

It has however, further been found that in addition to the molybdenum passing from the slag to the molten ferromolybdenum alloy beneath the slag in the bath, some of the carbon used to reduce the molybdenum oxide in the slag also passes through the slag and into the molten bath of ferromolybdenum alloy thereby increasing the carbon content of the molten alloy bath, which carbon content may thus exceed the maximum desired amount of 0.1% by weight carbon. In such cases it is necessary to decarburize the molten ferromolybdenum alloy in the molten bath in order to reduce the carbon content. Such decarburization may be effected by the addition of molybdenum oxide concentrate or iron oxide to the bath in a sufficient amount to effect the oxidation of the carbon and thus lower the carbon content in the molten ferromolybdenum alloy.

The process of the present invention may be operated on a batch basis or a continuous basis. Further, it has been found that in the batch technique, iron oxide is preferred as the decarburizing agent whilst molybdenum oxide is preferred in practicing the continuous process.

When operated on a batch basis, the slag at the termination of the smelting step and the slag stripping step is removed from the electric furnace and is suitably passed to waste. Subsequently, the molten alloy in the bath in the electric furnace is decarburized by the addition of either molybdenum oxide concentrate or iron oxide thereto preferably the latter due to its quick decarburization action so as to reduce the carbon content to less than 0.1% by weight. The molten alloy in the bath may then be recovered, if desired, shotted so as to be suitable for use as a furnace additive. It will be realized that the use of iron oxide as the decarburizing agent and as opposed to molybdenum oxide concentrate while having the advantage of a faster decarburization action has the disadvantage of slightly lowering the percentage of molybdenum in the ferromolybdenum alloy. However, this lowering of the molybdenum content can be anticipated in advance so as to control the desired final composition.

In the operation of the process on a continuous basis, at the termination of the smelting and before slag stripping of molybdenum in a particular cycle, molten ferromolybdenum alloy is tapped from the furnace, which alloy contains the molybdenum slag stripped from a previous cycle and subsequently the slag stripping is performed. After slag stripping, slag is removed from the furnace, and then a fresh charge of molybdenum oxide concentrate carbonaceous reducing agent and source of iron e.g. scrap steel is continuously added to the melt in the furnace to start a further cycle. The amount of the molybdenum oxide, scrap steel and carbon in the charge added to the furnace is sufficient, in addition to provide for the desired concentration of molybdenum in the ferromolybdenum alloy tapped from the furnace subsequently, to also lower the concentration of the carbon present in the molten alloy due to the slag stripping of the previous cycle. Preferably the molybdenum oxide concentrate is added in a sufficient amount to remove the carbon from the molten alloy bath due to the previous slag stripping. It has been found that as the carbon content of the molten bath increases, the molybdenum content of the slag decreases. Thus, in order to obtain an alloy directly without slag stripping of less than 0.1% carbon, the molybdenum in the slag is in the order of 5 to 6%. This can be lowered to less than 0.5% by slag stripping and, in general, in the continuous process the carbon and molybdenum oxide concentrate charged to the furnace may be controlled such that the carbon content of the molten alloy in the bath and the molybdenum content of the slag, immediately prior to molybdenum stripping of the slag, and immediately thereafter, advantageously cycles between 0.05 to 0.5% carbon and 4% to less than 0.5% molybdenum.

It will thus be seen that the present invention provides a process which produces ferromolybdenum containing at least 50% by weight molybdenum, containing low carbon content of maximum 0.1% by weight in a high molybdenum recovery, such recovery being in the order of 96% by weight or above with respect to molybdenum and also using an inexpensive carbonaceous reductant. As indicated above, the ferromolybdenum alloy may be shotted for use as a furnace additive. The process is thus operable on a commercial scale.

Further, the molybdenum recovery in the process can be further enhanced by fume recycling. It is found that the fume generated in the process has a sufficiently high molybdenum content to be recycled into subsequent smelting heats. A collection efficiency in fume recovery of 93% is considered adequate for economic fume recycling and the molybdenum recovery losses to the fume may be reduced to less than 1%.

DETAILED DESCRIPTION

Figure 1:
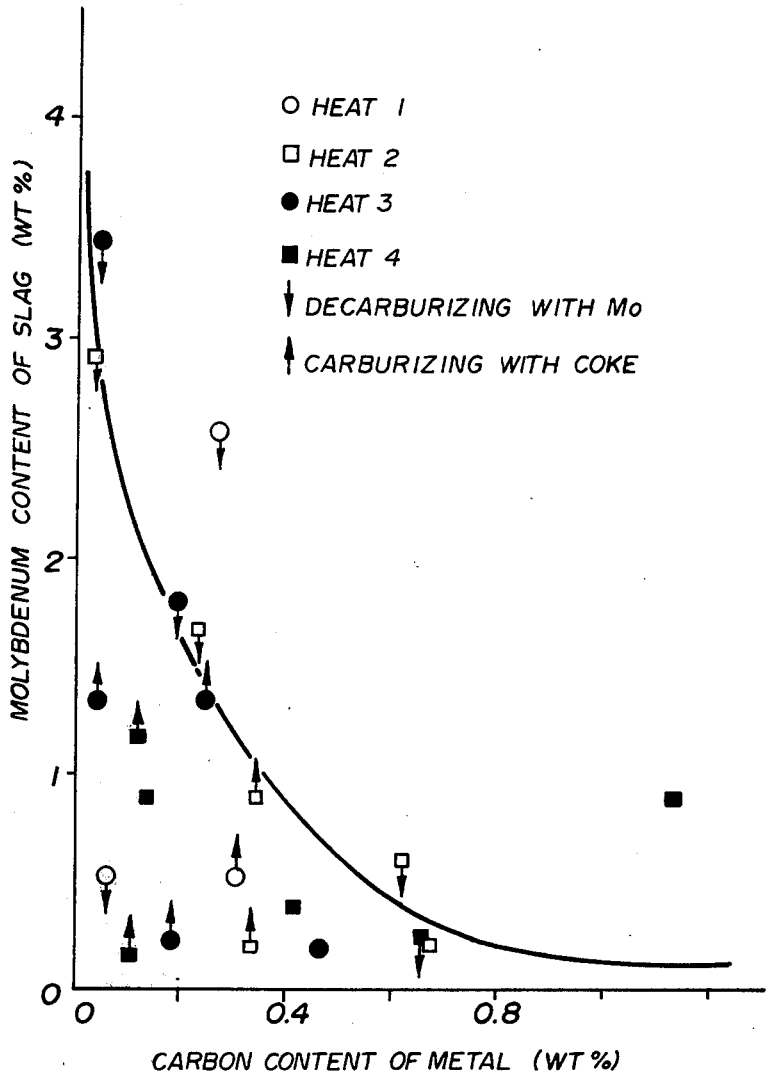

The present invention will be further illustrated by way of the following Examples:

EXAMPLE 1

1. Raw Materials

The raw materials used were not analysed completely; however, the more important constituents in the raw materials are as follows:

| | | (%) |
|---|---|---|
| molybdenum oxide conc | | |
| | Mo | 57.24 |
| | $SiO_2$ (by diff) | 14.12 |
| coke (−⅝" + ¼") | | |
| | fixed carbon | 89.3 |
| | ash | 9.3 |
| | volatile matter | 1.4 |
| | sulphur | 0.69 |
| limestone (−⅝" + ¼") | | |
| | CaO | 54.2 |
| quartz (−⅝" + ½") | | |
| | $SiO_2$ | 99 |
| iron-oxide pellets | | |
| | total iron | 65.3 |
| | $SiO_2$ | 5.61 |
| pig iron | | |
| | C | 4.0 |
| steel scrap | | |
| | C | 0.2 |

2. Equipment and Procedure

The furnace used was a 3 phase, 250 kVa electric arc furnace with graphite electrodes 5⅛ in. in diameter. The furnace shell was circular, 7 ft. in diameter and 4 ft. high and it was lined with about 13½ in. of basic brick. Inside of the brick-work was the furnace hearth which was about 7 in. thick and made from a rammed refractory high in magnesia. The furnace shell sits on a rotating mechanism and in these experiments the rotation was 1 revolution per hour. This permitted even distribution of the feed in the furnace. The furnace was cover with a roof, which was suspended. The roof had a door in it through which charge was introduced, and also openings for electrodes and for temperature measurement. At the end of each experiment, metal and slag were tapped into graphite moulds. The tap-hole was located about 1 in. above the furnace hearth and this allowed a heel of metal to remain in the furnace to protect the hearth. Previous to this work, the furnace was used for the production of pig iron and there remained in the furnace a heel of metal connaining 3% carbon. It was estimated, by visually examining the furance, that the heel of metal weighed about 300 lb. However, after the first experiment it was obvious that this heel of metal was about 3 times the size estimated.

In all of the experiments the furnace was preheated (about 1000° C.) for several days with a gas burner mounted on the side of the furnace shell. Before the experiment was begun, the burner was removed to permit rotation of the furnace shell when desired.

During the experiment samples of metal in the furnace were taken with a long spoon. The spoonful of metal was poured on to a steel plate for quick cooling. For purpose of control, the molybdenum content of the metal was determined quickly by X-ray fluorescence and that of the carbon by combustion. Both values were available about 15 min. after the samples were taken. Later the metal samples were reanalysed for molybdenum by standard wet chemical techniques.

After the experiment was completed, the products were cooled, the slag produced was crushed to about −½ in. and a sample was riffled and then ground to −100 mesh for chemical analysis.

The metal was sampled by breaking off small chips from the various ingots of metal produced, and then grinding these chips to −100 mesh for chemical analysis.

3. Smelting

Because each experiment was carried out in a slightly different manner in order to achieve specific objectives, the details of how each experiment was performed, are noted briefly.

EXPERIMENT 1

The objective was to produce about 1000 lb. of alloy containing about 50% Mo. As mentioned earlier a heel of iron that was at first estimated to weight about 300 lb. and which was known to contain 3% carbon, was in the furnace from previous work. Another 200 lb. of pig iron was placed in the preheated furnace in the area under the electrodes. Around the periphery of the hearth was placed a mixture of limestone and silica, to give a lime to silica ratio of 1.2 to 1. The purpose of the lime-silica mixture was to contain the pig iron after it was molten and to protect the walls of the hearth.

On top of the pig iron was placed 50 lb. of coke. The purpose of the coke was to provide an electrical path for the current and to cushion the movement of the electrodes and prevent their breaking.

The amount of molybdenum concentrate used was calculated to give about 50% molybdenum in the alloy. In order to prevent losses of molybdenum concentrate by dusting during charging, the concentrate was charged in steel cans, each containing five pounds of concentrate.

An estimate of the amount of coke required was determined by assuming the following reactions:

1. $MoO_3 + 3C \rightarrow Mo + 3CO$

2. $Fe_2O_3 + 3C \rightarrow 2Fe + CO$

The coke used to provide the electrical path for the furnace start-up is part of the coke required for reduction of molybdenum oxide as expressed in the above reaction.

The materials charged in each experiment are shown in Table 1 and the results obtained are shown in Table 2.

Results

The results show that the molybdenum content of the tapped metal was only 30.0%. This was much lower than expected and it was caused by dilution by the heel of metal in the furnace from previous work. Obviously this heel of metal was about 3 times greater than that estimated.

The quantity of metal produced (89 lb.) was less than expected (about 1000 lb.). The reason for this was that the hearth below the tap hole was larger than expected and nearly all of the alloy produced remained in the furnace.

Some frothy slag covered part of the furnace walls. After the furnace had cooled to room temperature this material was removed and it is reported as furnace clean out (FCO) in Table 2. Then the tap-hole was lanced open and lowered about 1½ inches, so that, in the next experiment, the heel of metal left in the furnace would not be excessive.

EXPERIMENT 2

The objective of this experiment was to decrease the size of the heel of metal in the furnace and then to increase the molybdenum content of the metal remaining in the furnace.

This experiment was carried out in a manner similar to that used in Experiment 1, except that iron oxide pellets plus some coke was used to start the furnace. The use of pellets instead of pig iron meant that less carbon had to be eliminated from the metal. Some fume was evolved during all the experimental work. During this experiment a sample of the fume was taken with a Staplex filter.

Results

The results show that the heel of metal in the furnace was decreased substantially. About 434 lb. of new metal were made (about 98 lb. of iron from the oxide pellets, 286 lb. of Molybdenum from the concentrate and 50 lb. steel from the cans) and 1022 lb. of metal were tapped (Tap 1:203 lb; Tap 2:819 lb). Also, the molybdenum content of the metal was increased substantially (i.e. from 32.7% to 43.1%). The sample of fume contained 41.24% Mo, and it is believed that this type of fume could be recycled.

EXPERIMENT 3

The objective in this experiment was to increase the molybdenum content of the metal in the furnace to about 55% molybdenum and in a dition, to produce about 900 lb. of ferromolybdenum containing about 55% molybdenum.

This experiment was performed in a manner similar to that used in Experiment 2, except that any iron required in excess of that supplied by the iron-oxide pellets, was added as steel scrap.

Near the end of the experiment, the carbon content was higher than desired (0.45%). To decrease the carbon in the metal, 50 lb. of iron-oxide pellets were added.

Results

The ferromolybdenum produced contained 55.2% molybdenum and 0.26% carbon. This carbon content was higher than desired (0.1%) but considerably lower than the value previous to adding iron oxide pellets (0.45%).

In all of these experiments there was some frothing and boiling of the slag. When frothing subsided, some of the frothy slag remained frozen on the furnace walls. When the furnace has cooled, this material was removed and it is noted in Table 2 as furnace clean out (FCO).

EXPERIMENT 4

This experiment was performed in a manner similar to that described in Experiment 3. Furnace clean out from Experiment 3 was placed around the periphery of the hearth.

Results

Ferromolybdenum containing about 58.65% Mo, 0.02% C and 0.01% silicon was produced. The value of 58.65% is the average of two samples taken i.e. one sample analysed 57.5% Mo and the other 59.8% Mo. It was observed in this experiment that there was obviously some segregration in the metal during cooling. This conclusion was reached because the top-middle portion of the ingot, which probably was the last to freeze, was only slightly magnetic whereas the bottom of the ingot was non-magnetic. It was then noted that the metal from Experiment 3 was similar except that the metal from the top-middle portion was more magnetic than that from Experiment 4. In Experiment 1 and 2, where the molybdenum content of the metal was low (30.0% and 43.1% Mo respectively) all of the metal was strongly magnetic.

Again, there was some frothing during the experiment similar to that experienced previously.

TABLE 1

| Duration, Electrical Energy and Materials Consumed | | | | |
|---|---|---|---|---|
| Experiment No. | 1 | 2 | 3 | 4 |
| Duration (min) | | | | |
| Meltdown | 177 | 205 | 144 | 155 |
| Smelting | 298 | 205 | 403 | 361 |
| Electrical Energy | | | | |
| Meltdown (kWh) | 642 | 810 | 635 | 470 |
| Smelting (kWh) | 1060 | 795 | 1580 | 1273 |
| kWh/lb oxide conc | 1.23 | 1.59 | 1.71 | 1.68 |
| Materials smelted (lb) | | | | |
| During meltdown | | | | |
| iron oxide pellets | | 150 | 150 | 150 |
| pig iron | 200 | | | |
| steel scrap | | | 74.2 | 1511.5 |
| coke | 50 | 26.3 | 26.3 | 26.3 |
| limestone | 223 | 294 | 25.9 | 78.1 |
| quartz | 100 | 100 | | |
| return slag | | | 241 Re Expt 2 | |
| furnace clean out | | | | 400 Re Expt 3 |
| During smelting | | | | |
| Mo oxide conc | 859 | 500 | 921.4 | 756 |
| coke | 114 | 126.5 | 245.7 | 179.4 |
| limestone | 222 | 207.5 | 341 | 295.2 |
| steel from cans* | 86 | 50 | 92 | 75.5 |
| iron-oxide pellets | | | 50 | |

*Each can weighed 0.5 lb. and contained 5 lb. of Mo oxide concentrate

TABLE 2

| Products and Chemical Analysis | | | | | |
|---|---|---|---|---|---|
| Experiment No. | 1 | 2 | | 3 | 4 |
| Product (lb) | | | | | |
| Metal Tap 1 | 89 | 203 | | 852 | 440 |
| Tap 2 | | 819 | | | |
| Slag Tap 1 | 255 | 127 | | 416 | 548 |
| Tap 2 | | 125 | | | |
| FCO* No 1 | 564 | | | 412 | 540 |
| No 2 | | TAP | | | 57 |
| Analysis (%) | | 1 | 2 | | |
| Metal Mo | 30.0 | 32.7 | 43.1 | 55.2 | 58.65 |
| C | 0.6 | 0.13 | 0.16 | 0.26 | 0.02 |
| Si | 0.02 | | 0.05 | 0.02 | 0.01 |
| Fe (by diff) | 67.56 | 67.17 | 56.69 | 44.52 | 41.32 |
| Slag Mo | 1.04 | 3.79 | 4.20 | 3.49 | 6.65 |
| Fe | 11.75 | 23.4 | 11.2 | 8.72 | 9.13 |
| CaO | 33.07 | 36.2 | 38.8 | 36.04 | 36.65 |
| MgO | 13.01 | 4.1 | 10.3 | 17.41 | 12.48 |
| $Al_2O_3$ | 3.19 | 2.4 | 4.1 | 4.19 | 3.68 |
| $CaO/SiO_2$ Ratio | 1.06 | 1.21 | 1.32 | 1.25 | 1.44 |
| | | | | 1 | 2 |
| FCO* Mo | 6.63 | 9.49 | | 8.8 | 31.4 |
| Fe | 20.9 | 11.39 | | 11.0 | 8.15 |

*FURNACE CLEAN OUT, which is material frozen on the furnace walls

It was not possible to make a molybdenum balance after each experiment because some metal and slag always remained in the furnace after tapping, and the quantity of each depended upon the level at which the tap-hole was lanced open. In a smelting furnace it is not always possible to lance open the tap-hole, each time, at exactly the same level. Therefore, it was decided, to make an overall molybdenum balance after the experimental work was completed.

At the end of the last experiment (Expt No. 4), the furnace was allowed to cool at room temperature. Then the metal and slag remaining in the furnace was dug out, crushed separately, then sampled, and analysed. An overall accountability was made and a brief summary is given in Table 3.

TABLE 3

| OVERALL MOLYBDENUM BALANCE | |
|---|---|
| Mo accounted for | (%) |
| in metal | 83.1 |
| in slag | 4.3 |
| in FCO | 8.0 |
| Mo unaccounted for (by difference) | 4.6 |

The results in Table 3 show that 4.6% of the molybdenum was unaccounted for. It is reasonable to assume that most of this 4.6% molybdenum loss was due to volatilization of molybdenum oxide during smelting. Most of the molybdenum oxide volatilized will be recoverable with suitable dust collecting equipment. In Experiment No. 2, samples of fume being evolved from the furnace were taken with a Staplex filter. It was found that the fume had a high molybenum content (41.24% Mo). Material with such a high molybdenum content may easily be recycled.

Some molybdenum was also lost to the slag and this loss can be divided into two types i.e., chemically-combined, and physically-entrapped molybdenum. The former is probably due to molybdenum oxide remaining chemically-combined in the slag and the latter is due to droplets of ferromolybdenum becoming physically entrapped in the slag during tapping and subsequent separation of metal and slag.

Such loss of chemically-combined molybdenum may be minimized by reducing the molybdenum oxide in the slag, towards the end of the experiment, with additions of carbon. More coke in the charge would also decrease the loss of molybdenum to the slag, however, the carbon content of the metal might then be increased to unacceptable levels.

EXAMPLE 2

1. Raw Materials

Materials used in this example were commercial grade molybdenum oxide, coke, burnt lime, ferrosilicon and scrap steel. Analyses of the important constituents of these materials are presented below, together with the form in which they were received.

| | |
|---|---|
| Molybdenum Oxide | 59.59% Mo approx. 10% $SiO_2$<br>37 lbs. oxide in a 2 lb. steel can |
| Coke | Fixed Carbon 85.63% Ash 12.2%<br>Volatiles 1.97% Dried Breeze Coke<br>3/8" × 1/16" in 50 lb. bags |
| Burnt Lime | Assumed 100% CaO, 80 lbs. bags |
| Ferrosilicon | 75% Si 25% Fe, 1/4" × down |
| Steel | Approx. 0.2% C, steel plate |

2. Equipment

The furnace used for smelting was a three phase, three electrode 3000 kVa furnace, with 8 inch diameter graphite electrodes and a maximum capacity of about 18,000 lbs. metal. The furnace shell was lined with one course of magnesia brick on top of which was rammed basic refractory (approx. 60% MgO). The inside of this shell was circular in cross section with a 5'6" diameter and was 26" in depth below the tap hole. To faciliate refractory repairs and to allow batch charging before start-up, the roof and electrodes could be raised and swung to one side.

The furnace was equipped with a 12"×18" front loading door which was used for charging during smelting. Both slag and metal were tapped through a single hole on the side opposite from the loading door, the furnace, with roof and electrodes, being tipped for this operation. Fumes were extracted through a one foot diameter duct which extended from the furnace roof through an extractor fan to the bag house.

3. Procedure

3(a) Overall Smelting and Shotting Procedure

All smelting was performed with the following general practice. An initial charge of steel, together with 80 lbs. lime was melted under full power. During this melt down, charge units consisting of 1000 lbs. Molybdenum Oxide, 250 lbs. coke and 320 lbs. lime were prepared. When the initial charge was molten and at a temperature of approximately 1450° C., smelting began. Each charge unit was added to the furnace at a uniform rate over a predetermined period (about 1 hour in most of this work). Thus, for example, one can of oxide together with approximately equal sized shovels full of coke and of lime was added every two minutes. Up to five charge units were used in any one heat.

Bath temperatures generally increased as smelting proceeded, and attempts were made to hold the maximum temperature at 1760° C. The most satisfactory arc length resulted from using a voltage tap which gave 205 volts. This ensured that the electrodes stayed out of the metal bath and dipped only into slag, thus minimizing carbon pick up from the electrodes by the metal.

Throughout smelting, close control was exercised over the carbon content of the metal. Samples were taken after every charge unit by dipping a steel spoon into the bath and withdrawing a small amount of metal. An analysis of weight percent carbon in this sample could then be obtained within 15 minutes. Then, making appropriate reductions in coke additions, the carbon content was readily controlled to below 0.1%.

A final sample of metal was obtained just prior to tapping, and random samples of metal pig or shot were also analysed. Random samples of slag were collected after solidification in the slag pot. In addition to quick carbon analysis, the metal could be analysed for Mo within 3 hours. Slag samples were processed at a later time.

After smelting was completed, ferrosilicon and lime were added to strip the slag. The furnace contents were then tipped into a preheated 5000 lb. ladle, the first ladle full containing mostly slag, the second, mostly metal. Slag was back poured from the ladle into slag pots.

Metal was shotted by pouring the tapping ladle into another unlined 5000 lb. ladle containing running water from a 2¼" fire hydrant hose. The water flow rate was about 3000 lbs/minute and a metal drop height of about 4 feet was used. In this way, 2000 lbs. of metal could be shotted in 10 to 15 minutes before erosion of the ladle lip made pouring difficult. The shot was loaded into 40 gallon drums and dried overnight at about 300° F.

3(b) Smelting Procedures for Individual Heats

Four heats were made with the overall procedure outlined above. The charging rate appropriate for a given energy input was calculated for the first heat from example 1. Charging rates, energy input and other relevant details of procedure for the initial and subsequent heats are presented below.

Heat 1

A comparatively low power input target of 1000 Kwh/hr was chosen for the first heat, and an overall average of 965±150 Kwh/hr was achieved. A charge rate of one can of oxide every two minutes was employed, and the overall energy per unit charge for smelting alone, was 1.03 Kwh/lb oxide (Table 4).

All of the metal tapped was cast into pig; no shotting was attempted.

Heat 2

Since the first heat had been reasonably trouble free, it was decided to increase the charge rate by 33%, loading one can of oxide every 1½ minutes. The power input was between 516 and 989 Kwh/hr and an average of 0.74 Kwh/lb Mo oxide was consumed during smelting. With the initial meltdown charge of scrap, 1910 lbs. FeMo was also added, with the aim of providing additional protection for the newly lined furnace bottom.

Smelting was discontinued after 3-16/27 of the planned five charge units, after prolonged and excessive boiling caused slag to froth up through the charging door. An estimated 500 lbs. FeMo was lost in this way, and the furnace was tipped to avoid further spillage. Attempts to control the bath with ferrosilicon additions only succeeded when the boil was moderate, and in the end it was decided to turn off the power, and allow the bath to quieten. The furnace was tapped into a 5000 lb. teapot ladle, from which the remaining slag was backpoured and the metal was shotted and pigged.

Heat 3

The objective for this heat was to repeat the conditions of Heat 1, by making continuous calculations of the energy input. Before the heat was started the solidifed slag which remained on the furnace side walls after Heat 2, was chipped away with a jack hammer. During smelting, the power input was held between 960 and 1070 Kwh/hr, the charge rate was one can oxide every two minutes and the energy consumed was 0.84 Kwh/lb oxide. Because of a time limit set by the end of a shift, the furnace was tapped aftet the addition of 3-18/27 charge units.

The furnace was tapped into a 5000 lb. open face ladle which was used in preference to a teapot ladle, since the latter had proved difficult to clear of metal solidified after ladling Heat 2. Tapped slag was poured into pots, and metal shotted.

Heat 4

For this heat, the objective was to successfully smelt a full five charge units. This was achieved with the following smelting conditions: the charge rate was one can every two minutes, and the overall energy consumed was 1 Kwh/lb oxide. Average power inputs for each of the five units were 1059, 774, 1292 and 875 Kwh/hr respectively. Tapping and shotting was carried out as in Heat 3.

RESULTS

Weights of materials charged and products obtained are shown in Table 5. Details of the product analyses are shown in Table 6. Electrical power consumption is summarized in Table 4 and the overall average of almost 2 KW per pound of Mo smelted can be taken as the amount of power required for the process on a commercial scale.

In contrast, the Mo recovery balance which is shown in Table 7 should not be taken as an estimate of the maximum recovery achievable by full-time commercial oepration; the significance of these recovery figures will be discussed at length below.

TABLE 4

ELECTRICAL POWER CONSUMPTION

| | HEAT 1 | HEAT 2 | HEAT 3 | HEAT 4 |
|---|---|---|---|---|
| Power Consumed During Smelting Alone (Kwh) | 5161 | 2643 | 3078 | 4999 |
| Power Used to Smelt One Pound of Mo Oxide (Kwh) | 1.03 | 0.74 | 0.84 | 1.00 |
| Total Power Consumed (Kwh) | 6468 | 4000 | 4078 | 5798 |
| Overall Power Used Per Pound Mo (Kwh) | 2.15 | 1.85 | 1.85 | 1.94 |

TABLE 5

MATERIALS CHARGED AND PRODUCTS TAPPED

| | HEAT 1 | HEAT 2 | HEAT 3 | HEAT 4 |
|---|---|---|---|---|
| Materials Charges (lb) | | | | |
| (a) before smelting: | | | | |
| Steel Plate | 1218 | 2030 | 1218 | 812 |
| Lime | 80 | 80 | 80 | 80 |
| Other | | 1910 FeMo 50% Mo | | |
| (b) during smelting: | | | | |
| Mo Oxide | 5000 | 3592 | 3665 | 5000 |
| Coke | 1250 | 925 | 850 | 1150 |
| Lime | 1600 | 1120 | 1200 | 1600 |
| Steel (plate & cans) | 1182 | 194 | 198 | 1488 |
| (c) after smelting: | | | | |
| Ferrosilicon | 100 | 150 | 200 | 200 |
| Lime | — | — | 400 | 560 |
| Tapped Produce (lb) | | | | |
| Metal Shot | — | 1053 | 2180 | 2560 |
| Pig | 5000 | 3775 | — | 550 |
| Furnace Heel/Ladle Skull | 1144 | — | 750 | 750 |
| Slag | 4000 | 1072 | 2000* | 5200 |

* estimated

TABLE 6

CHEMICAL ANALYSES OF TAPPED PRODUCTS

| | HEAT 1 | HEAT 2 | HEAT 3 | HEAT 4 |
|---|---|---|---|---|
| Metal Analysis (wt %) | | | | |
| Mo | 41.3 | 46.7 | 53.8 | 54.1 |
| C | 0.05 | 0.08 | 0.06 | 0.06 |
| Fe | | 51.5 | 44.1 | 43.1 |
| Si | 0.08 | 0.05 | 0.11 | 0.08 |
| Other | 4.6 Ni | | | |
| Slag Analysis (wt %) | | | | |
| $MoO_3$ | 7.19 | 6.10 | 8.98 | 11.30 |
| (Mo) | (4.79) | (4.07) | (5.93) | (7.53) |
| $Fe_2O_3$ | 15.93 | 18.84 | 19.48 | 16.98 |
| (Fe) | (11.15) | (13.19) | (13.64) | (11.89) |
| CaO | 29.20 | 40.44 | 34.48 | 34.32 |
| MgO | 13.58 | 11.59 | 10.98 | 11.13 |
| $SiO_2$ | 24.17 | 25.70 | 28.56 | 27.06 |
| $Al_2O_3$ | 3.77 | 1.06 | 0.98 | 1.12 |
| Other ($Cr_2O_3$) | 5.63 | | | |

TABLE 7

| Mo RECOVERY (ALL HEATS) | |
|---|---|
| % of Charged Mo in tapped metal | 81.6 |
| % of Charged Mo lost to slag | 6.7 |
| % of Charged Mo in other losses | 11.7 |

The results presented in Tables 5, 6 and 7 give a record of the significant progress made towards the fulfillment of the objectives of electric arc-ferromolybdenum production program.

The objective of 50% molybdenum was achieved in Heats 3 and 4 (Table 6) and could also have been achieved in Heats 1 and 2, in the absence of other, unrelated experimental problems. (After Heat 1, the alledgedly clean furnace was found to have, in fact, contained a stainless steel heel which diluted the ferromoloybdenum. Heat 2 was finished prematurely because of an excessive boil).

The objective of 0.1% Max. was also readily attained; carbon was monitored after the addition of each charge unit, and adjustments in subsequent coke additions allowed the carbon to be held below the required maximum.

The shotting objective was fulfilled in that a shotted product was obtained.

The product would be even more attractive if the average particle size was larger, and this could be achieved by using a metal stream of larger diameter. However, there is a limitation on the metal flow rate which is set by the available water flow rate, and this factor restricted the size of shot obtainable using this technique.

The molybdenum recovery objective was not achieved in these experiments. Mo recovery figures as shown in Table 7. The proportion of Mo converted to ferromolybdenum is disappointingly low. However, the program is still at an experimental stage, and the production facilities used in this work were far from ideal. It is more fruitful to examine the sources of Mo loss and to assess to what extent these losses may be reduced. In Table 7, the losses have been divided into two groups; namely, losses to the slag, and other losses, and discussion is presented under these two headings.

4(a) Losses to the Slag (1) Chemically Bound Mo: Between 6 and 7% of the Mo charged in the furnace remained in the slag (Table 7). This figure is substantially higher than that required before the process may be considered commercially feasiable. However, it may be reduced to below 1% by slag stripping.

4(a) (2) Physically Bound Mo: Operating conditions were such that slag and metal had to be tapped together into the same ladle. Consequently, there was some unavoidable metal/slag mixing. Even though the slags seemed to be very fluid, some metal shot was entrained in the slag; this was confirmed by microscopic examination of cast slag.

4(b) Other Mo Losses

Under this heading are considered all sources of Mo loss not previously discussed, including losses in the fume, to the furnace and ladle linings, and metal spillage. As shown in Table 7 these losses amount to about 12% of the Mo charged overall.

Any of these losses in which Mo is associated with Fe can be isolated by examination of the Fe recovery for the system. Included in this category of losses are spillage of metal, slag and metal not removed from the furnace, and perhaps losses to the lining; excluded from this group are fume losses, since iron or iron oxide fuming is negligible.

The Fe recovery (Table 8) shows that for Heats 2–4, all but about ½% of the iron can be accounted for in tapped metal or slag. Heat 1 is not considered because the furnace contained an unknown weight of iron before start-up. This leads to the conclusion that the 12% Mo deficit shown under "other losses" in the Mo mass balance, Table 7, is for the most part, Mo lost in the fume. This 12% compares with a figure of 4.6% for similar losses in the work on the 250 kVa furnace, where no fume extraction was used.

TABLE 8

| Fe RECOVERY (HEATS 2–4) | |
|---|---|
| % of Charged Fe in tapped metal | 85.5 |
| % of Charged Fe in tapped slag | 14.2 |
| % of Charged Fe unaccounted for | 0.3 |

* estimated

6. Projected Mo Losses in a Commercial Operation

Qualitative sampling of the fume in example 1 has shown that it has a high enough Mo content to be recycled into subsequent smelting heats. Assuming that this practice had been possible in the present work, the recovery of charged Mo in this work, viz. 81.6% in the metal, 6.7% in the slag and 11.7% other losses, would then have been in the order of 91% in metal, 7% in slag and 2% other.

EXAMPLE 3

(1) Raw Materials

Materials used in Example 3 were commercial grade molybdenum oxide, coke, burnt lime, scrap steel and pig iron whose compositions were as in example 2.

In this Example the molybdenum oxide was in the form of broken pillow briquettes. Also used were ferromolybdenum and molybdenum rich slag from previous work which had the following analyses:

FeMo shot: 51.8% Mo, 0.05% C, 0.05% Si, balance Fe Slag, crushed to minus ⅜": 6.38% Mo, 16.0% $Fe_2O_3$, 30.1% $SiO_2$, 24.5% CaO, 9.26% MgO.

Up to 44% of the slag Mo content was in the form of physically entrapped FeMo shot; by substraction the chemically bound slag Mo content was at least 3.6% Mo.

(2) Equipment

The heats were performed in a 250 kVa Lectromelt electric arc furnace which was three phase with a maximum power output of 250 kVa and had three 2½ inch vertical electrodes. The 24 inch diameter circular shell give a maximum melt capacity of 500 lbs., with a depth of about 6 inches below the tap hole. The furnace hearth was rammed Perimix (91% MgO), the sides bare magnecon bricks (53.3% MgO) and the roof CRL Mullite Plastic (70% $Al_2O_3$). Back slagging and front pouring ware performed through the funace door and opposite tap hole by tipping the furnace and electrode assembly. Additions were made through the furnace door. Four transformer taps delivered 160, 130, 110 and 90 volts respectively; power input was adjustable with three rheostats and was monitored by a kilowatt hour/-hour meter.

(3) Procedure (a) General Procedure

The general practice for each of the heats was to begin with the melting of 200 lbs. FeMo shot under full power, and 100 lbs. slag was added during this meltdown, so that when melting was complete the furnace contained low carbon ferromolybdenum covered by a Mo rich slag, as would be the case after a batch smelting run just prior to tapping.

Throughout this work good control was exercised over both temperatures, the target metal temperature being 1625° C. This was easily achieved on tap 2 (130 volts) controlling power input at between 80 and 120 kW. Temperatures were measured a regular intervals wit Temp-Tip disposable thermocouples.

Metal and slag samples were taken by dipping with a steel spoon; rapid carbon analyses were determined with a LECO analyser within 5 minutes. Wet chemical analysis confirmed carbon and provided Mo, Fe and Si analysis within a week.

After each run was complete, the furnace contents were cast into a sand mold 9" wide by 4" deep and 4' in length.

(b) Procedures for Individual Heats

The following procedures were undertaken for individual heats in addition to those outlined in the previous section.

HEAT 1

After meltdown of the metal, 5 lbs. of coke was added with the slag, leaving the metal carbon content at 0.31% C. After this reduction step, the slag was removed. Then two charge units, each containing 10 lbs. Mo oxide, 4.2 lbs. steel, 2.7 lbs. coke and 1.7 lbs. lime, were smelted to decarburize the metal. Two further charge units were added and when the bath was quiet, the heat was tapped.

Heat 2

The object was to follow procedures for Heat 1, carburizing to a higher carbon content. To this end 10 lbs. of coke were added to the slag, taking the metal carbon content to 0.34% C, after which 20 lbs. of pig iron was added increasing the carbon content to 0.68% C. The slag was removed. Then a total of 60 lbs. Mo oxide, 12.6 lbs. steel, 6.8 lbs. coke and 11 lbs. lime were added to the furnace in five charge units over a period of 71 minutes, and the heat was tapped.

Heat 3

There were three objectives for this heat. The first was to generate more metal carbon content/slag Mo content data, the second to decarburize with iron ore, and the third was to test the effectiveness of a pack-bed fume collection system.

After melting the metal and some of the slag, 6 lbs. of coke was added mixed with equal portions of slag, followed by the remainder of the slag. 10.5 lbs. of pig iron were added to complete carburization, and half of the slag was removed.

A total of 20 lbs. Mo oxide, 4.2 lbs. steel, 2.7 lbs. coke, and 4 lbs. lime was charged in two units. At this stage, with the metal carbon content 0.18% C, 10 lbs. of ore was added and when the boil subsided, the furnace was tapped.

Heat 4

This last heat also had three objectives, the main one of which was to collect fume during meltdown and smelting. The second objective was to test the feasilibity of reducing a Mo rich slag with FeSi in a ladle, and the third was to confirm the results of heat 3.

After meltdown of both metal and slag, half the slag was backpoured into a 100 lbs. ladle with a 9 lb. FeSi addition. This molten slag was then teemed twice between two ladles and poured into a slag pot.

Carburization of the metal was continued by charging a total of 15 lbs. coke and 41 lbs. pig iron. Decarburization followed with a total of 20 lbs. Mo oxide, 2 lbs. coke and 4 lbs. lime in two units. Finally, 14 lbs. of ore was added in two batches. Fume was collected throughout the run. After the bath had quietened, the furnace contents were tapped into a 250 lbs. ingot mold.

RESULTS

The results of wet chemical analysis are given in Table 9, together with details of the operation performed prior to sampling. Discussion of the implications of these results is given in the proceeding section.

Fume recovery met with good success; a collection efficiency of 93% was attained.

Reduction of Slag with Coke

Using analyses from the heats, the relationship between slag Mo content and metal carbon content is potted in FIG. 1. Despite the apparently scattered data points, the equilibrium between slag Mo content and metal C content is well defined, taking into account the following biases. Firstly, data gathered during coke additions will fall below the equilibrium line since the coke floats on the top of the slag, reducing it locally without entering the metal. Conversely, data gathered whilst decarburizing with Mo oxide, fall above the line since the extra carbon required for reduction is in the metal bath below with only limited access to the newly added oxide. Arrows marked in FIG. 1 indicate conditions prior to sampling, and point towards the equilibrium line.

This figure shows that:

(1) An acceptably low level of 0.5% Mo in the slag is in equilibrium with a metal bath containing approximately 0.5% C.

(2) After additions of coke, slag Mo contents much less than 0.5% Mo result in metal carbon levels of at least 0.190 C. It is thus not advisable to use coke for slag reduction at the end of batch smelting, without subsequent decarburization, since metal carbon levels will rise above the ASTM specified maximum. However, additions of coke along during continuous smelting can be used to strip the slag Mo content to less than 0.5% Mo.

Decarburizing the Metal (a) Mo Oxide Additions

The metal carbon can be brought to as low as 0.04% C by additions of Mo oxide as occurred in Heat 2. Similar results have been obtained in previous tests as Example 1 where it was found that metal carbon levels could be easily controlled to less than 0.1% C by withholding coke during smelting.

(b) Iron Ore Additions

The use of iron ore to decarburize the metal met with complete success. The required quantity of ore was found to be the same as that needed to decarburize a bath of steel, namely about 6 lbs. lump iron ore per percent carbon per 100 lbs. metal. Clearly this is a valuable method for fast decarburization.

This practice results in the addition of iron to the metal bath. In the case of a 50% FeMo bath to be decarburized by 0.1% C, the metal analysis is changed to 50.2% Fe 49.8% Mo.

Smelting with a Thin Slag Cover

Analyses from Heat 1 illustrate a problem caused by smelting with a thin slag cover. After backslagging, very little slag remained to cover the metal, and subsequent additions of Mo oxide were such that carbon in the metal fell quickly from 0.31% to 0.05%. At this stage however, the slag cover was not sufficient to prevent the electrodes from dipping into the metal, and carbon from the electrodes contaminated the bath. The electrodes were "pencilled" and the metal carbon level rose to 0.27% C over a period of 33 minutes.

Fume Collection

A collection efficiency of 93% is very adequate for economic fume recycling. If fume had been recycled using such a system for Example 1 above, the Mo recovery losses to the fume would have been reduced to less than 1%.

Table 9:

| | | Sample Analyses | | | | | | | | | | |
|---|---|---|---|---|---|---|---|---|---|---|---|---|
| | | Metal (wt %) | | | Slag (wt %) | | After Addition of: | | | | | |
| Heat No. | Sample No. | Mo | Si | C | Mo | Fe | FeSi | Coke | Pig Iron | Mo Iron | Iron Ore | Remarks |
| 1 | 1 | 51.2 | | 0.31 | 0.51 | 8.58 | | X | | | | |
| | 2 | | | 0.05 | | | | | | | | Held for 12 mn. + |
| | 3 | | | 0.07 | 1.40 | 11.0 | | X | | X | | Slag barred down |
| | 4 | | | | | | | X | | X | | |
| | 5 | 51.3 | | 0.27 | 2.56 | 6.26 | | | | | | Tapped |
| 2 | 1 | | | 0.35 | 0.88 | | | X | | | | |
| | 2 | | | 0.34 | 0.20 | | | | | | | Held for 29 mn. |
| | 3 | | | 0.68 | 0.20 | | | | X | | | |
| | 4 | | | 0.56 | 0.62 | | | X | | X | | |
| | 5 | | | 0.24 | 1.67 | | | | | X | | |
| | 6 | | | 0.24 | 7.03 | | | | | X | | |
| | 7 | | | 0.04 | 2.92 | | | | | | | Tapped |
| 3 | 1 | | | 0.25 | 1.33 | | | X | | | | |
| | 2 | | | 0.19 | 0.22 | | | | | | | Held for 22 mn. |
| | 3 | | | 0.47 | 0.18 | | | | X | | | |
| | 4 | | | 0.65 | | | | X | | X | | |
| | 5 | | | 0.20 | 1.79 | | | | | X | | |
| | 6 | | | | | | | | | X | | |
| | 7 | 51.1 | | 0.05 | 3.43 | | | | | | | Tapped |
| | 8 | | | | 0.21 | | | | | | | Backpour |
| 4 | 1 | | | | 5.44 | | | | | | | Meltdown |
| | 2 | | | 0.12 | 1.16 | | | X | | | | |
| | 3 | | | 0.11 | 0.14 | | | X | | | | |
| | 4 | | | 1.13 | 0.87 | | | | X | | | |
| | 5 | | | 0.66 | 0.22 | | | X | | X | | |
| | 6 | | | 0.42 | 0.38 | | | | | | X | |
| | 7 | 45.9 | | 0.14 | 0.89 | | | | | | X | |
| | 8 | | | | 4.69 | | X | | | | | Ladle |

What we claim as our invention is:

1. A process for the production of a ferromolybdenum alloy having a molybdenum content of at least 50% by weight and a carbon content not exceeding 0.1% by weight with a high recovery of molybdenum which process comprises introducing into a melt containing iron in a furnace, a charge of a molybdenum oxide concentrate, a carbonaceous reductant for said concentrate and a source of lime, said molybdenum oxide concentrate being charged in an amount to provide the required concentration of molybdenum in the alloy and the carbon reductant being charged in an amount to cause reduction of the molybdenum oxide concentrate, simultaneously smelting said charge in said melt to form a molten ferromolybdenum alloy bath with a slag covering said bath, adding a carbonaceous material to said slag in an amount sufficient to cause a substantial proportion of molybdenum contained in said slag to be stripped therefrom and pass into said bath, and recovering molten ferromolybdenum alloy from said bath not exceeding 0.1% by weight of carbon.

2. A process as clamed in claim 1, wherein said furnace is an electric arc furnace and wherein said charge is continuously added to said melt containing iron during smelting.

3. A process as claimed in claim 2, which is operated on a batch system and in which at the termination of said smelting and after subsequent addition of the carbonaceous material for slag stripping, the molten alloy of the bath is decarburized by the addition of at least one of molybdenum oxide concentrate and iron oxide thereto in an amount sufficient to lower the carbon content to an amount not exceeding 0.1% by weight.

4. A process as claimed in claim 2, which is operated on a continuous basis in a plurality of cycles and which in any cycle at the termination of the smelting a portion of the molten alloy is removed from the bath as product and at the termination of the molybdenum stripping of the slag, a portion of the slag is removed and a further charge containing molybdenum oxide concentrate, a source of lime, a source of iron and carbonaceous material is added to the bath for the next smelting cycle, the amount of molybdenum oxide charged being sufficient to oxidize the carbon in the bath to thereby lower the carbon content of the bath at the termination of smelting to no more than 0.1% by weight.

5. A process as claimed in claim 2, in which the iron in said bath is provided by at least one of pig iron, iron oxide and steel.

6. A process as claimed in claim 2, in which the source of lime is burnt lime.

7. A process as claimed in claim 4, in which the carbon and molybdenum oxide concentrate charged to the furnace is controlled such that the carbon content of the molten alloy and the molybdenum content of the slag immediately prior to molybdenum stripping, and immediately thereafter, cycles between 0.05% to 0.5% carbon and 4% to less than 0.5% molybdenum.

8. A process as claimed in claim 2, in which the carbonaceous reductant is coke.

9. A process as claimed in claim 2, in which the slag is maintained as a basic slag.

10. A process as claimed in claim 2, in which the fluidity of the slag is increased by the addition of a slag fluidizing agent thereto.

11. A process as claimed in claim 2, in which molten alloy removed from the bath is subsequently shotted.

* * * * *